US008700387B2

(12) United States Patent
Ubale et al.

(10) Patent No.: US 8,700,387 B2
(45) Date of Patent: Apr. 15, 2014

(54) METHOD AND SYSTEM FOR EFFICIENT TRANSCODING OF AUDIO DATA

(75) Inventors: Anil Ubale, Cupertino, CA (US); Partha Sriram, Los Altos, CA (US)

(73) Assignee: Nvidia Corporation, Santa Clara, CA (US)

( * ) Notice: Subject to any disclaimer, the term of this patent is extended or adjusted under 35 U.S.C. 154(b) by 1230 days.

(21) Appl. No.: 11/521,094

(22) Filed: Sep. 14, 2006

(65) Prior Publication Data

US 2008/0071528 A1 Mar. 20, 2008

(51) Int. Cl.
*G10L 21/00* (2013.01)

(52) U.S. Cl.
USPC ..... 704/205; 704/220; 704/500; 700/94; 455/556.1; 386/328

(58) Field of Classification Search
USPC ..... 704/205; 725/31, 131; 705/402; 375/240.26, 204.21, 240.2; 348/462
See application file for complete search history.

(56) References Cited

U.S. PATENT DOCUMENTS

| | | | | |
|---|---|---|---|---|
| 5,585,931 | A | 12/1996 | Juri et al. | |
| 6,259,741 | B1 * | 7/2001 | Chen et al. | 375/240.26 |
| 6,442,206 | B1 * | 8/2002 | Hrusecky | 375/240.21 |
| 6,647,061 | B1 * | 11/2003 | Panusopone et al. | 375/240.12 |
| 2002/0181794 | A1 * | 12/2002 | Lee | 382/250 |
| 2003/0014241 | A1 * | 1/2003 | Ferris et al. | 704/200.1 |
| 2003/0079222 | A1 * | 4/2003 | Boykin et al. | 725/31 |
| 2005/0018796 | A1 * | 1/2005 | Sande et al. | 375/350 |
| 2005/0117056 | A1 * | 6/2005 | Aprea et al. | 348/462 |
| 2005/0229231 | A1 * | 10/2005 | Lippincott | 725/131 |
| 2007/0061522 | A1 * | 3/2007 | Vink | 711/154 |
| 2009/0198753 | A1 * | 8/2009 | Benjelloun Touimi | 708/313 |

OTHER PUBLICATIONS

Madisetti, Vijay K. The Digital Signal Processing Handbook. CRC Press LLC. 1998. Chapters 37 and 40. pp. 37-2, 37-3, 37-4, 40-6, 40-10, 40-12, 40-13, 40-15, 40-16.*

Abdellatif Benjelloun Touimi et al. "Efficient Conversion Method Between Subband Domain Representations", Jul. 2005, IEEE, pp. 1-4, Speech and Sound Technologies and Processing Lab., France Telecom Research & Development.*

* cited by examiner

*Primary Examiner* — Douglas Godbold
*Assistant Examiner* — Mark Villena

(57) ABSTRACT

Methods and systems for transcoding input audio data in a first encoding format to generate audio data in a second encoding format, and filterbanks for use in such systems. Some such systems include a combined synthesis and analysis filterbank (configured to generate transformed frequency-band coefficients indicative of at least one sample of the input audio data by transforming frequency-band coefficients in a manner equivalent to upsampling the frequency-band coefficients and filtering the resulting up-sampled values to generate the transformed frequency-band coefficients, where the frequency-band coefficients are partially decoded versions of input audio data that are indicative of the at least one sample) and a processing subsystem configured to generate transcoded audio data in the second encoding format in response to the transformed frequency-band coefficients. Some such methods include the steps of: generating frequency-band coefficients indicative of at least one sample of input audio data by partially decoding frequency coefficients of the input audio data; generating transformed frequency-band coefficients indicative of the at least one sample of the input audio data by transforming the frequency-band coefficients in a manner equivalent to upsampling the frequency-band coefficients to generate up-sampled values and filtering the up-sampled values; and in response to the transformed frequency-band coefficients, generating the transcoded audio data so that the transcoded audio data are indicative of each sample of the input audio data.

27 Claims, 5 Drawing Sheets

METHOD AND SYSTEM FOR EFFICIENT TRANSCODING OF AUDIO DATA

FIELD OF THE INVENTION

The invention pertains to methods, systems, and circuitry for transcoding audio data.

BACKGROUND OF THE INVENTION

Throughout this disclosure (including in the claims) the term "comprises" denotes "is" or "includes," and the expression "in a manner equivalent to" denotes either "by" or "in a manner not identical to but equivalent to."

Throughout this disclosure (including in the claims) the term "transcoding" denotes decoding encoded data (that have been previously encoded in a first encoding format) and re-encoding the decoded data in a second encoding format. Typically, the decoding step of a transcoding operation includes the step of performing decompression on compressed data (that have previously been encoded in a first compression format), and the re-encoding step of a transcoding operation includes the step of performing a data compression operation to generate transcoded data in a second compression format.

In recent years consumer electronic devices employing audio compression have achieved tremendous commercial success. The most popular category of these devices includes the so-called MP3 players and portable media players. Such a player can store a number of user-selected songs in compressed format on a storage medium present in the player, and also includes electronic circuitry that decodes and decompresses the compressed songs in real time. With proliferation of various audio compression formats (e.g., MPEG1-Layers I, II, III, MPEG2-AAC, WMA, and AC3), the need for transcoding of audio between different compression formats is becoming commonplace.

Audio data transcoding is required when audio data received or stored in one format (e.g., one compressed format) needs to be encoded into another format (e.g., a different compressed format). Audio data transcoding from a first format to a second format is always undesirable unless the second format is lossless. This is because a second lossy encoding of audio data introduces additional distortion. In practice the need for transcoding usually arises when various parts of an audio processing chain require different audio codecs. The producer of compressed audio content may choose to encode the content in one preferred format, and yet it may be desired to play back the encoded content using a device whose only (or final stage) processing circuitry is designed for use with content encoded in a different format. The reasons for using different audio codecs during different parts of the audio chain include differences in industry standards, desired bit rate, quality, decoding complexity, channel characteristics.

In order for a consumer electronic device to be interoperable across industry standards, it is often necessary for the device to perform transcoding on audio data. For example, such devices may include components (or subsystems) that receive and decode only audio data having one of a small number of mandatory compressed formats (e.g., only audio data having one such format), and thus need to include at least one additional transcoding component or subsystem in order to support at least one audio format other than the mandatory formats.

Since the introduction of the first portable audio players in the market in 1997, MPEG1-Layer III (or "MP3") audio format has become the de-facto standard for portable media players. The format has been so successful that the term MP3 has is sometimes used as a synonym for compressed audio and the expression MP3 player is sometimes used to denote any portable audio player. In typical MP3 player usage the listener keeps the MP3 player in a pocket or attaches it to a belt. Earbud phones or headphones worn by the listener are often connected to the MP3 player by a jack and wires. With the introduction of the wireless Bluetooth protocol and standardization of audio transport on Bluetooth links, use of wireless headphones is becoming popular. In a typical wireless headphone usage scenario, a MP3 player is equipped with a Bluetooth transmitter and a wireless headphone is equipped with a Bluetooth receiver.

The Bluetooth (A2DP) specification supports various audio compression formats, including linear PCM, Sub Band Coding ("SBC"), MPEG1-LIII and others. SBC is specified to be a mandatory codec and is guaranteed to be supported by all Bluetooth compliant wireless headphones. Implementing a portable audio player to transmit audio in MP3 or other non-SBC formats from a portable audio player over a wireless link is undesirable where there is no assurance that readily available wireless headphones will be able to decode the audio transmitted over the wireless link. On the other hand, even when a portable audio player is implemented to transmit audio data in SBC format over a Bluetooth link, it will typically be undesirable to store the audio content in SBC format in the player for at least two reasons: first, storing the content in the player in SBC format rather than MP3 format would require more memory space for the same quality because SBC codecs are less efficient than MP3 codecs; and second, all legacy content will likely need to be encoded in SBC format. Therefore in wireless headphone applications, there is a definite need for transcoding of MP3 format audio data (e.g., audio data in MP3 format stored in a portable audio player) to SBC format audio data (for transmission over a wireless Bluetooth link).

Audio compression in accordance with most formats in use today (including the MP3 and SBC formats) employs perceptual transform coding. In perceptual transform coding, time-domain samples of input audio are first converted into frequency-domain coefficients using an analysis filterbank. The frequency-domain coefficients at the output of analysis filterbank are then quantized using perceptual criteria in order to achieve the highest audio quality at the desired bit rate. At the decoder, the frequency-domain coefficients are reconstructed through the process of inverse quantization of the quantized coefficients. The reconstructed frequency-domain coefficients are then transformed back to time-domain audio samples using a synthesis filterbank.

A conventional, straight-forward approach to transcoding input audio data in a first encoding format (where the input audio data comprise frequency-domain coefficients that have undergone quantization using perceptual criteria) is to:

(a) decode the input audio data by:

(i) demultiplexing and decoding the incoming encoded bit-stream (which is encoded in the first encoding format) and producing quantized frequency domain coefficients, (ii) generating reconstructed frequency-domain coefficients using inverse quantization, and then (iii) transforming the reconstructed frequency-domain coefficients to time-domain audio samples using a synthesis filterbank; and (b) after step (a), re-encode the time-domain audio samples in accordance with a second encoding algorithm to generate transcoded audio data comprising frequency-domain coefficients having a second encoding format. Typically, step (b)

includes the steps of generating additional frequency-domain coefficients by transforming the time-domain audio samples generated in step (iii) using an analysis filterbank, and performing quantization on the additional frequency-domain coefficients using perceptual criteria, and then multiplexing the quantized coefficient indices into a bit-stream in second encoded audio format.

The steps of bitstream demultiplexing (step (a)(i)) and multiplexing (the last operation in step (b)) as described above will be omitted in the following discussion because their details are not relevant to the invention, but they are typically performed by both conventional transcoding systems and transcoding systems that embody the present invention.

FIG. 1 is a block diagram of a system performing this conventional transcoding operation, using a first perceptual transform audio codec to perform step (a) and a second perceptual transform audio codec to perform step (b). The system of FIG. 1 performs MP3 encoding of audio data (using analysis filterbank 2 and quantization circuits Q), transcodes the resulting MP3 format audio data (using inverse quantization circuits IQ, synthesis filterbank 4, analysis filterbank 6, and quantization circuits Q', connected as shown) to generate transcoded audio data having SBC format, and performs SBC decoding on the transcoded audio data (using inverse quantization circuits IQ' and synthesis filterbank 8) to generate time-domain samples of decoded audio data.

MPEG1-Layers I, II, and III all use a pseudo perfect-reconstruction quadrature mirror filterbank (QMF) for time-domain to frequency-domain transformation during encoding. Such an analysis filterbank decomposes the time-domain signal to be encoded into 32 streams of frequency coefficients (also referred to as 32 "frequency band signals" or 32 streams of "frequency-band coefficients"), each corresponding to a different one of 32 different frequency bands. The MPEG1-Layer III ("MP3") encoding method further decomposes each of such 32 frequency sub-band signals into 18 streams of frequency-domain coefficients (which are also "frequency band signals," each corresponding to a different one of 18 different frequency sub-bands of one of the 32 frequency bands, and are sometimes referred to herein as "frequency sub-band signals" or streams of "frequency sub-band coefficients") using a modified discrete cosine transform. Thus a 576-band analysis filterbank can be used to convert time-domain samples of input audio into 576 streams of frequency sub-band coefficients (which are then quantized) to implement MP3 encoding.

The SBC algorithm also uses a pseudo perfect-reconstruction QMF for time-domain to frequency-domain transformation during SBC encoding. Such an analysis filterbank decomposes the time-domain signal to be encoded into 4 or 8 frequency bands. Thus, a four-band (or eight-band) analysis filterbank can be used to convert time-domain samples of input audio into 4 (or 8) streams of frequency-domain coefficients (which then undergo quantization) to implement SBC encoding.

In FIG. 1, blocks Q and Q' indicate circuitry configured to perform quantization (during encoding) and blocks IQ and IQ' indicate circuitry configured to perform inverse quantization (during decoding).

The system of FIG. 1 includes 576-band MP3 analysis filterbank 2 which outputs 576 streams of frequency sub-band coefficients (frequency-domain data) in response to a stream of time-domain audio data samples to be encoded. Each of these coefficients is quantized in circuit blocks Q to generate MP3-encoded audio data (quantized frequency-domain coefficients). Each of the coefficients can be quantized in one of circuit blocks Q or more than one of the coefficients can be quantized in each of at least some of blocks Q (the circuit blocks Q can but need not all receive the same number of streams of frequency band coefficients).

The MP3-encoded audio data are transcoded in circuit blocks IQ, synthesis filterbank 4, analysis filterbank 6 and circuit blocks Q'. Filterbank 4 is cascaded with filterbank 6. Circuit blocks IQ perform inverse quantization on each of the 576 streams of quantized frequency sub-band coefficients generated in response to input data samples, and the resulting inverse-quantized coefficients are processed in 576-band MP3 synthesis filterbank 4 to recover the audio data (a sequence of time-domain samples) that was originally input to filterbank 2.

The time-domain samples of recovered audio data then undergo SBC encoding in analysis filterbank 6 (which is an eight-band SBC analysis filterbank) and quantization circuits Q'. Filterbank 6 outputs eight streams of frequency sub-band coefficients (frequency-domain data) in response to a stream of time-domain audio data samples received from filterbank 4, and these coefficients are quantized in circuit blocks Q' to generate SBC-encoded audio data (SBC-encoded, quantized frequency-domain coefficients). Each of the coefficients output from filterbank 6 can be quantized in one of circuit blocks Q' or more than one of the coefficients can be quantized in each of at least some of blocks Q' (the circuit blocks Q' can but need not all receive the same number of streams of frequency sub-band coefficients).

The SBC-encoded audio data are decoded in circuit blocks IQ' and SBC synthesis filterbank 8 (which is a four-band or eight-band SBC synthesis filterbank). More specifically, the quantized frequency sub-band coefficients output from blocks Q' undergo inverse quantization in circuit blocks IQ' and the resulting inverse-quantized coefficients are processed in synthesis filterbank 8 to recover the audio data (a sequence of time-domain samples) that was originally input to filterbank 6.

During conventional encoding (e.g., MP3 or SBC encoding) of audio data of the types discussed above, it is known to implement an analysis filterbank as a first stage configured to perform anti-aliasing (or low-pass) filtering followed by a second stage configured to perform discrete cosine transform (e.g., an MDCT, during MP3 encoding). A cascade of such a first stage and such a second stage is equivalent to (and can implement) a filter stage (that implements any of a broad class of filtering operations) followed by a decimation (down-sampling) stage.

During conventional decoding (e.g., MP3 or SBC decoding) of audio data of the types discussed above, it is known to implement a synthesis filterbank as a first stage configured to perform an inverse discrete cosine transform (IDCT) followed by a multi-input multi-output low-pass filtering operation. A cascade of such a first stage and such a second stage is equivalent to (and is derived from) an up-sampling stage followed by a filter stage (that implements a bank of parallel band-pass filters that are cosine-modulated versions of a low-pass prototype filter). The first approach that uses IDCT is commonly used in practical implementations because of its efficiency.

The inventors have appreciated that it is inefficient to implement transcoding by using a synthesis filterbank (implemented as an up-sampling stage followed by a filter stage, or as an IDCT followed by anti-aliasing filter stage) followed by an analysis filterbank (implemented as a filter stage followed by a down-sampling stage, or as a anti-aliasing filter stage followed by DCT stage). There are several reasons for this including that use of such implementations of filterbanks require undesirably complex computations and require an undesirably large amount of memory for storing coefficients for implementing the filtering operations.

To appreciate the following description of embodiments of the present invention, it is helpful to consider characteristics of frequency-band coefficients (e.g., frequency sub-band coefficients, such as those generated during MP3 encoding of audio data that are asserted from analysis filterbank 2 of the conventional FIG. 1 system to quantization circuits Q) that are generated in a manner equivalent to time-to-frequency-domain transformation of time-domain audio data. Frequency-band coefficients of this type can also be viewed as time-domain samples that filtered using a narrow-band filter and downsampled and can be described in the same terms as if they were time-domain audio data. For example, a stream of frequency-band coefficients can usefully be described as being up-sampled or down-sampled (as if it were a stream of samples of time-domain audio data).

Also in the following description of embodiments of the invention, the expressions that frequency coefficients (e.g. frequency-band coefficients) "are indicative of" or "determine" at least one time-domain sample of audio data (in the context of processing the coefficients to decode or transcode the audio data) denote that performing predetermined decoding operations on the coefficients (e.g., processing them in a synthesis filterbank having predetermined characteristics) can recover the at least one time-domain sample of audio data therefrom.

SUMMARY OF THE INVENTION

In a class of embodiments, the invention is a system for transcoding input audio data in a first encoding format to generate audio data in a second encoding format, said system including:

a combined synthesis and analysis filterbank configured to generate transformed frequency-band coefficients indicative of at least one time-domain sample of the input audio data by transforming frequency-band coefficients in a manner equivalent to upsampling the frequency-band coefficients to generate up-sampled coefficients and filtering the up-sampled coefficients to generate the transformed frequency-band coefficients, where the frequency-band coefficients determine said at least one time-domain sample (e.g., the frequency-band coefficients are partially decoded versions of each said sample of the input audio data in the first encoding format, generated by inverse quantizing quantized frequency coefficients that themselves determine each said sample of the input audio data); and a processing subsystem coupled and configured to generate transcoded audio data in the second encoding format in response to the transformed frequency-band coefficients, such that the transcoded audio data are indicative of the at least one time-domain sample of the input audio data.

In some embodiments in this class, the filterbank includes:

an up-sampling stage coupled and configured to receive the frequency-band coefficients and to generate up-sampled values in response thereto; and a filter stage coupled and configured to filter the up-sampled values to generate the transformed frequency-band coefficients.

In typical embodiments in this class, the filterbank is configured to generate the transformed frequency-band coefficients by performing a small number of cosine transforms (e.g., MDCTs or other discrete cosine transforms), each on a different subset of the frequency-band coefficients, to generate cosine-transformed data, and performing low-pass filtering on the cosine-transformed data. For example, when the system is configured to perform MP3-to-SBC transcoding and the frequency-band coefficients are partially decoded versions of frequency coefficients in MP3 format, some embodiments of the filterbank are configured to generate the transformed frequency-band coefficients by performing eight 72×72 MDCTs, each on a different subset of the frequency-band coefficients, to generate MDCT output data, and low-pass filtering (e.g., using eight 198-point FIR filters, or other small FIR filters) the MDCT output data.

In some such embodiments in the noted class (including some embodiments configured to perform MP3-to-SBC (or MPEG1(Layer I)-to-SBC or MPEG1(Layer II)-to-SBC) transcoding in which the input audio data are MP3-encoded audio data), the filterbank is a maximally-decimated filterbank. For example, in some embodiments configured to perform MP3-to-SBC transcoding, such a maximally-decimated filterbank may be configured to generate the transformed frequency-band coefficients by (or in a manner equivalent to) generating 72× up-sampled values in response to the frequency-band coefficients, filtering the 72× up-sampled values in a set of 576 filters to generate streams (e.g., 576 streams) of filtered values, and combining subsets of the filtered values to generate the transformed frequency-band coefficients. For another example, in some embodiments configured to perform MPEG1(Layer I)-to-SBC (or MPEG1 (Layer II)-to-SBC) transcoding, such a maximally-decimated filterbank may be configured to generate the transformed frequency-band coefficients by (or in a manner equivalent to) generating 4× up-sampled values in response to the frequency-band coefficients, filtering the 4× up-sampled values in a set of 32 filters to generate 32 streams of filtered values, and combining subsets of the filtered values to generate the transformed frequency-band coefficients.

The processing subsystem can include a quantization stage configured to generate quantized, transformed frequency-domain coefficients having the second encoding format in response to the transformed frequency-band coefficients.

In some embodiments, the inventive system also includes an inverse quantization stage that is coupled and configured to receive quantized frequency-band coefficients of the input audio data (which are in the first encoding format and typically have undergone quantization using perceptual criteria), to perform inverse quantization on the quantized frequency-band coefficients (typically also using perceptual criteria) to generate the frequency-band coefficients, and to assert said frequency-band coefficients to the filterbank.

In some embodiments of the inventive system, the input audio data in the first encoding format are MP3-encoded audio data, and the transcoded audio data in the second encoding format are SBC-encoded audio data.

In another class of embodiments, the invention is a method for transcoding input audio data in a first encoding format to generate transcoded audio data in a second encoding format, including the steps of:

(a) generating frequency-band coefficients that are indicative of at least one sample of the input audio data by partially decoding frequency-band coefficients of the input audio data in the first encoding format (e.g., by performing inverse quantization on quantized frequency coefficients of the input audio data to generate the frequency-band coefficients);

(b) generating transformed frequency-band coefficients indicative of the at least one sample of the input audio data by transforming the frequency-band coefficients in a manner equivalent to upsampling said frequency-band coefficients to generate up-sampled values and filtering the up-sampled values to generate the transformed frequency-band coefficients; and (c) in response to the transformed frequency-band coefficients, generating the transcoded audio data in the second encoding format such that said transcoded audio data are indicative of the at least one sample of the input audio data.

In some such embodiments, step (b) includes the steps of: upsampling said frequency-band coefficients to generate up-sampled values; and filtering the up-sampled values in a filterbank to generate the transformed frequency-band coefficients.

In some such embodiments, step (b) includes the steps of: generating cosine-transformed data by performing a small number of cosine transforms (e.g., MDCTs), each on a different subset of the frequency-band coefficients; and low-pass filtering the cosine-transformed data. For example, when the method performs MP3-to-SBC transcoding and the frequency-band coefficients are partially decoded versions of frequency coefficients in MP3 format, step (b) can include the steps of generating the transformed frequency-band coefficients by performing by performing eight 72×72 MDCTs, each MDCT on a different subset of a set of 576 frequency-band coefficients, to generate MDCT output data, and low-pass filtering the MDCT output data (e.g., using eight 198-point FER filters, or other small FIR filters).

In some embodiments (e.g., embodiments in which the method performs MP3-to-SBC transcoding, or MPEG1 (Layer I)-to-SBC or MPEG1(Layer II)-to-SBC) transcoding), step (b) includes the step of generating the transformed frequency-band coefficients by transforming the frequency-band coefficients in a manner equivalent to upsampling said frequency-band coefficients to generate up-sampled values and filtering the up-sampled values in a maximally-decimated filterbank to generate the transformed frequency-band coefficients. In some such embodiments (in which the method performs MP3-to-SBC transcoding), the method transcodes input audio data in MP3 format to generate transcoded audio data in SBC format, and step (b) includes the step of generating the transformed frequency-band coefficients by transforming the frequency-band coefficients in a manner equivalent to generating 72× up-sampled values in response to the frequency-band coefficients, filtering the 72× up-sampled values in a set of 576 filters to generate 576 streams of filtered values, and combining subsets of the filtered values to generate the transformed frequency-band coefficients.

Step (c) can include the step of quantizing the transformed frequency-band coefficients to generate said transcoded audio data.

Other aspects of the invention are filterbanks (preferably implemented as integrated circuits, or subsystems of integrated circuits, or as a program stored in digital signal processor or general-purpose processor) for use in any embodiment of the inventive system, and methods performed during operation of any embodiment of the inventive system.

DETAILED DESCRIPTION OF PREFERRED EMBODIMENTS

A class of embodiments of the inventive system will be described with reference to FIGS. 2 and 4. The system of FIG. 2 performs MP3 encoding of input audio data (using analysis filterbank 2 and quantization circuits Q), transcodes the resulting MP3 format audio data (using inverse quantization circuits IQ, synthesis and analysis filterbank 5, and quantization circuits Q', connected as shown) to generate transcoded audio data having SBC format, and performs SBC decoding on the transcoded audio data (using inverse quantization circuits IQ' and synthesis filterbank 8) to generate time-domain samples of decoded audio data. All elements of FIG. 2 that are labeled identically in FIGS. 1 and 2 are identical to the corresponding elements of FIG. 1, and the foregoing description of them will not be repeated with reference to FIG. 2.

Figure 1:
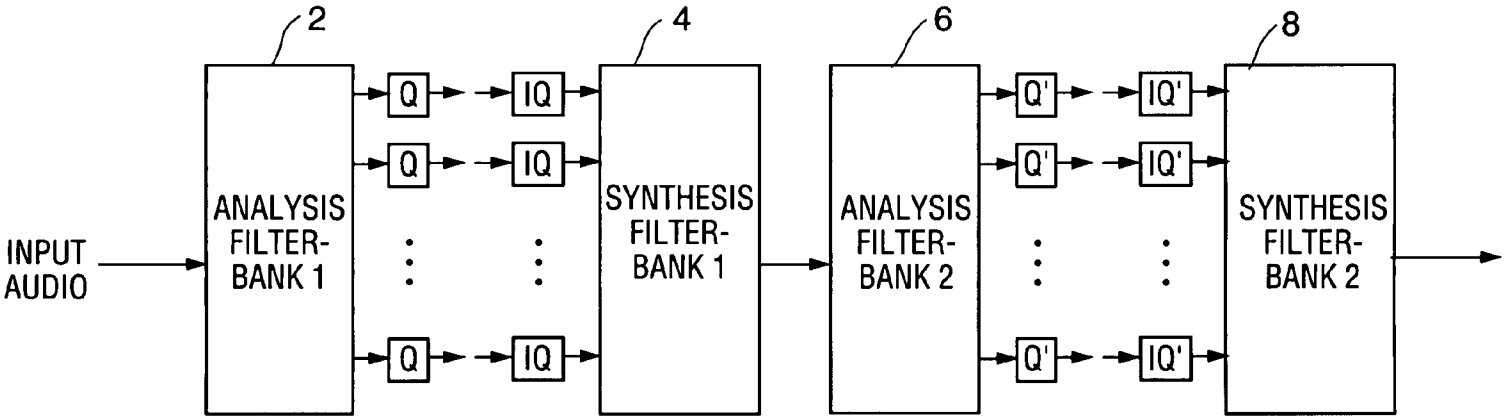
FIG. 1 (PRIOR ART)
FIG. 1 is a block diagram of a conventional audio data transcoding system.
Figure 2:
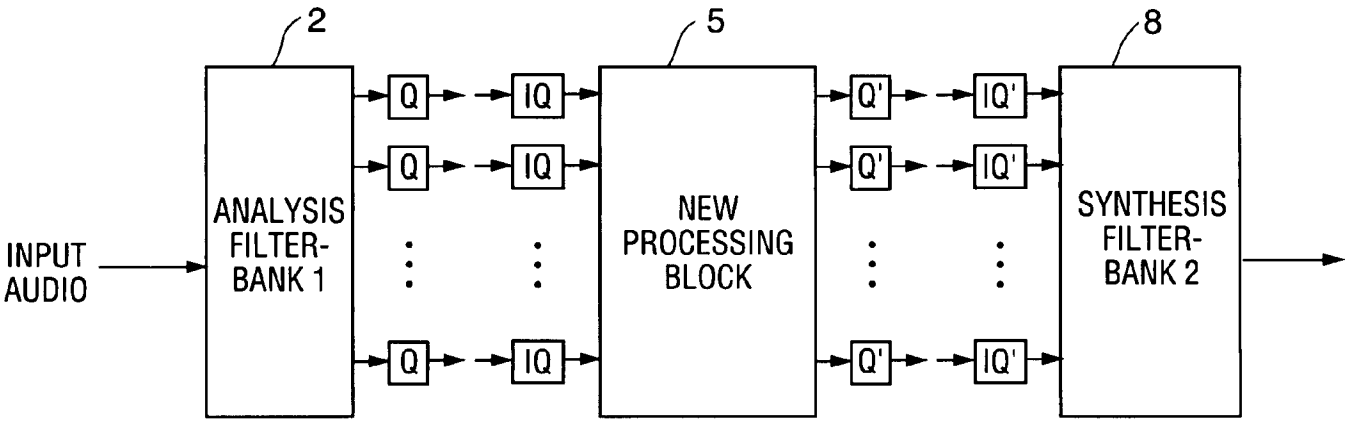
FIG. 2 is a block diagram of an embodiment of the inventive audio data transcoding system.
Figure 3:
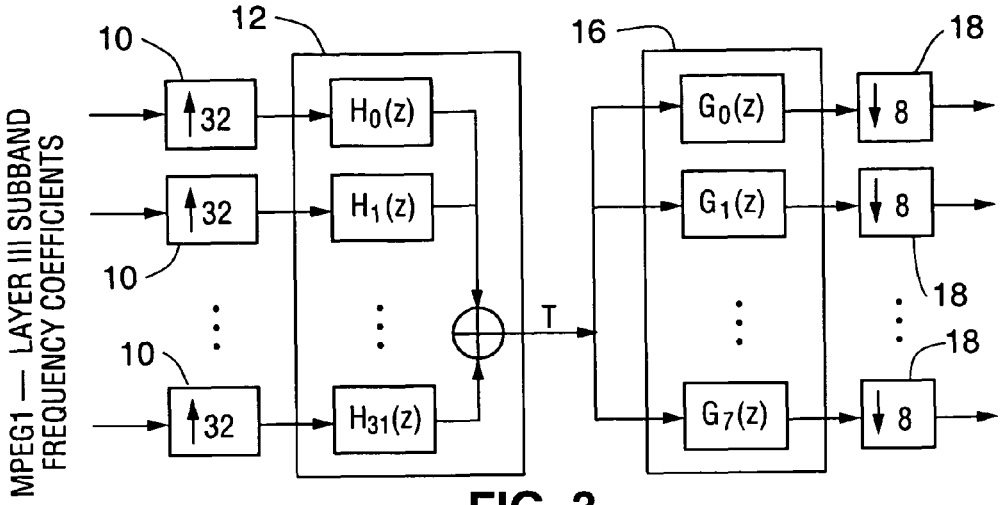
FIG. 3 (PRIOR ART)
FIG. 3 is a block diagram of a simplified implementation of filterbanks 4 and 6 of the FIG. 1 system.

The FIG. 2 system performs transcoding efficiently in accordance with the invention using a combined synthesis and analysis filterbank 5 configured to generate (and assert to quantization circuits Q') transformed frequency-domain coefficients in response to frequency-domain coefficients of audio data from inverse quantization circuits IQ without performing synthesis filtering (as performed by filterbank 4 of FIG. 1 or elements 10 and 12 of FIG. 3) following by separate analysis filtering (as performed by filterbank 6 of FIG. 1 or elements 16 and 18 of FIG. 3). Thus filterbank 5 replaces a conventional cascade of separate synthesis and analysis filterbanks (e.g., cascaded filterbanks 4 and 6 of FIG. 1, in which filterbank 4 reconstructs the original input audio samples that were input to analysis filterbank 2 and asserts them to analysis filterbank 6, and filterbank 6 generates transformed frequency-domain coefficients in response thereto).

Figure 4:
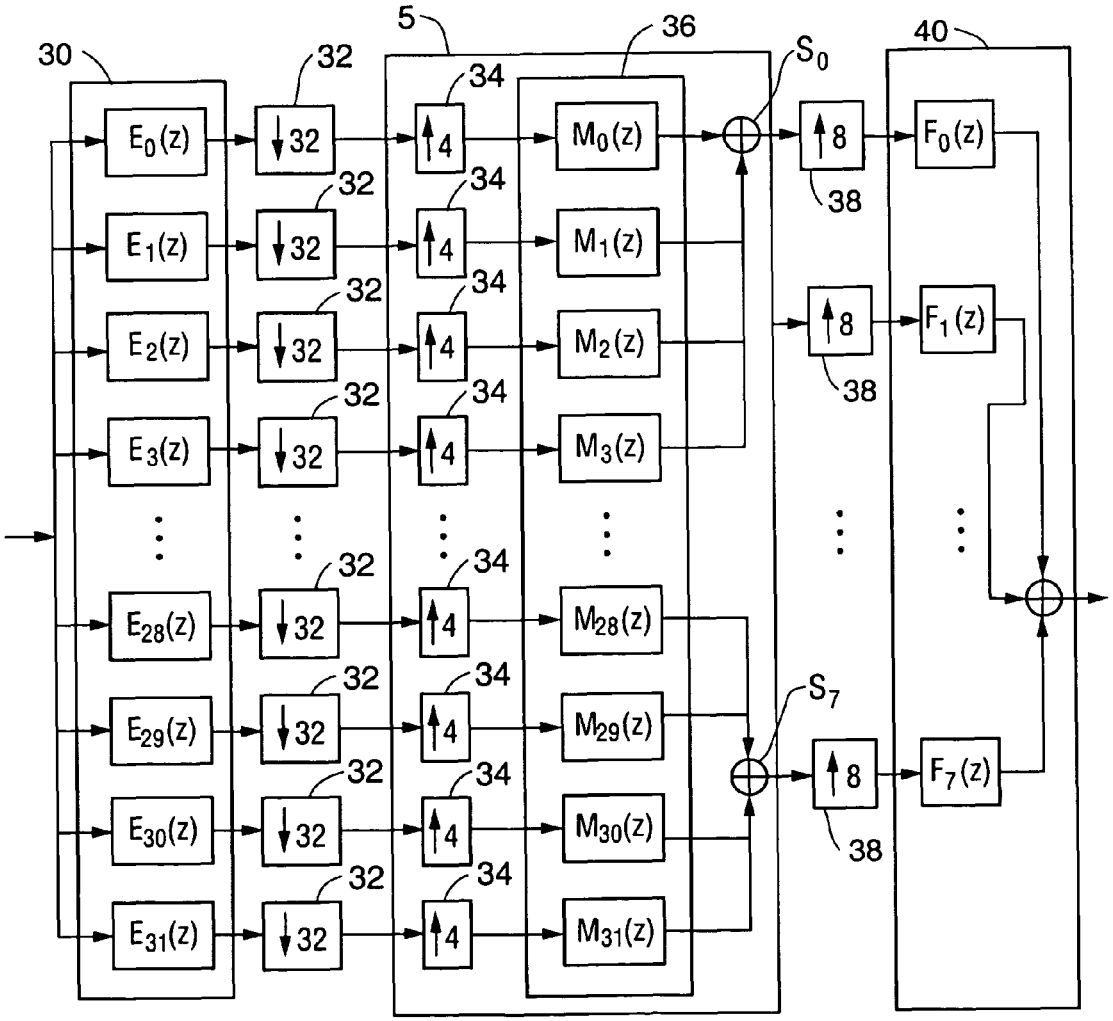
FIG. 4 is a block diagram of elements of a simplified, maximally-decimated implementation of filterbank 5 of FIG. 2, also including blocks that indicate filtering functions implemented by other elements of the FIG. 2 system.

Next, with reference to FIGS. 3 and 4 we explain and contrast in more detail the manner in which the systems of FIGS. 1 and 2 perform transcoding. Recall that in FIGS. 1 and 2, filterbanks 4 and 5 receive 576 streams of frequency-band coefficients of MP3 format audio data and filterbanks 6 and 5 output eight streams of frequency-band coefficients of SBC format audio data to quantization circuits Q'. For simplicity, FIGS. 3 and 4 show (and their description assumes) only thirty-two filters in each of encoder 30 and stages 12 and 36, and thirty-two circuits 10, 32, and 34, for generating and transcoding thirty-two streams of frequency-band coefficients in response to a stream of time-domain input audio samples. Thus, the structures shown in FIGS. 3 and 4 (and FIG. 6 to be discussed below) could be employed to implement MPEG1(Layer I)-to-SBC transcoding or MPEG1

(Layer II)-to-SBC transcoding. It will be apparent from the explanation below how the description of each of FIGS. 3 and 4 (and FIG. 5) should be modified to explain how the systems of FIGS. 3, 4, and 6 can implement MP3-to-SBC transcoding.

FIG. 4 is a block diagram of a simplified implementation of filterbank 5 of FIG. 2, in which blocks 30, 32, 38, and 40 indicate filtering functions implemented by other elements of FIG. 2. Up-sampling circuits 34 and filters 36 of filterbank 5 perform all their processing operations on data in the frequency domain. However, since these operations are performed on frequency-band coefficients having characteristics that are similar to those of time-domain samples of audio data, these operations will be described as if they were performed on time-domain samples of audio data. For example, each stream of frequency-band coefficients asserted to one of up-sampling circuits 34 is described herein as being up-sampled by such circuit 34 as if it were a stream of time-domain samples of audio data.

Similarly, FIG. 4 assumes that MP3 encoder 30 and decimation (down-sampling) circuits 32, and up-sampling circuits 38 and SBC decoding filterbank 40 of FIG. 4 system perform all processing operations in the frequency domain. However, since circuits 32 and 38 operate on frequency-band coefficients having characteristics that are similar to those of time-domain audio data, the operations of circuits 32 and 38 (and encoder 30 and filterbank 40) will be described as if they were performed on time-domain samples of audio data. For example, each stream of frequency-band coefficients asserted to one of down-sampling circuits 32 is described as being down-sampled by such circuit 34 as if it were a stream of time-domain samples of audio data.

Figure 5:
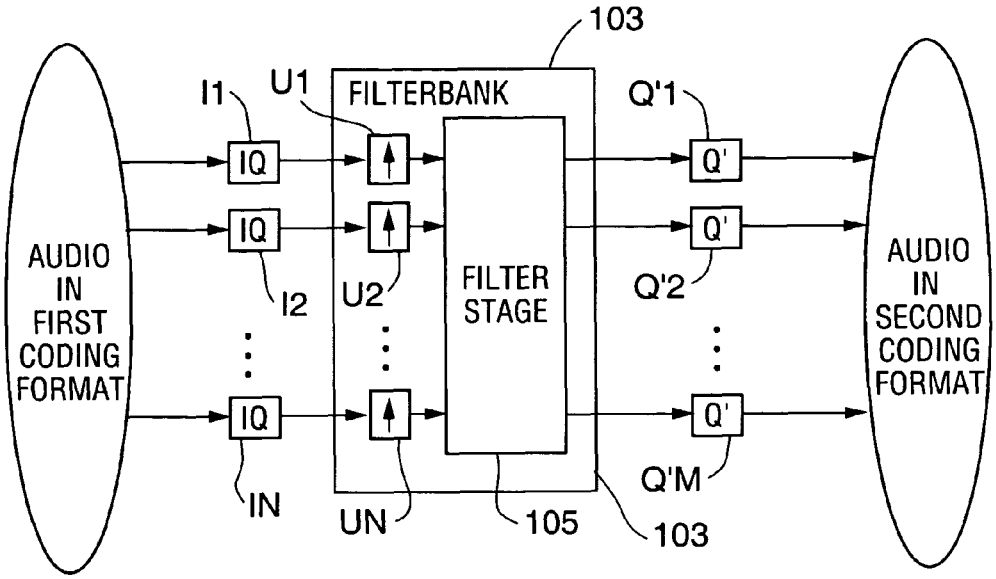
FIG. 5 is a block diagram of an embodiment of the inventive transcoding system.

FIG. 5 is a block diagram of a system for implementing transcoding in accordance with the invention to generate M streams of quantized frequency coefficients (quantized frequency-band coefficients) of data having a second encoding format (with M coefficients of such data, one from each stream, being indicative of M samples of audio data) in response to N streams of quantized frequency coefficients (quantized frequency-band coefficients) of data having a first encoding format (with N coefficients of such data, one from each stream, being indicative of N samples of audio data), where N and M are arbitrary numbers that satisfy N>M and M=N/L (where L is described below). For example, in case of MP3-to-SBC transcoding, N=576, M=8, and L=72.

Typically, the N streams of quantized frequency-domain coefficients to be transcoded by the FIG. 5 system have been quantized using perceptual criteria in order to achieve the highest audio quality at the desired bit rate. The FIG. 5 system includes an inverse quantization stage (comprising N inverse quantization circuits I1, I2, . . . , and IN) configured to reconstruct the original (pre-quantization) frequency-domain coefficients of audio data by performing inverse quantization thereon. The reconstructed frequency-domain coefficients are asserted to filterbank 103.

Filterbank 103 implements partial transcoding of the data values from the inverse quantization stage in accordance with the invention and asserts the partially transcoded data values to a quantization stage (comprising M quantization circuits Q'1, Q'2, . . . , and Q'M). More specifically, a new set of N data values is clocked into filterbank 103's up-sampling stage (comprising N up-sampling circuits, U1, U2, . . . , and UN) once per N clock cycles, and is clocked out of the up-sampling stage to filter stage 105 once per N/M clock cycles. Filter stage 105 of filterbank 103 generates a new set of M filtered frequency coefficients once per each N/M clock cycles in response to each set of N data values from the up-sampling stage.

Filter stage 105 asserts each such set of M partially transcoded frequency coefficients to the quantization stage comprising quantization circuits Q'1, Q'2, . . . , and Q'M. The quantization stage performs quantization on the partially transcoded frequency coefficients (typically in accordance with perceptual criteria) to generate a set of M fully transcoded frequency-domain coefficients (once per M clock cycles). These fully transcoded frequency-domain coefficients can then undergo conventional decoding to reconstruct the original time-domain audio samples therefrom.

Figure 5A:
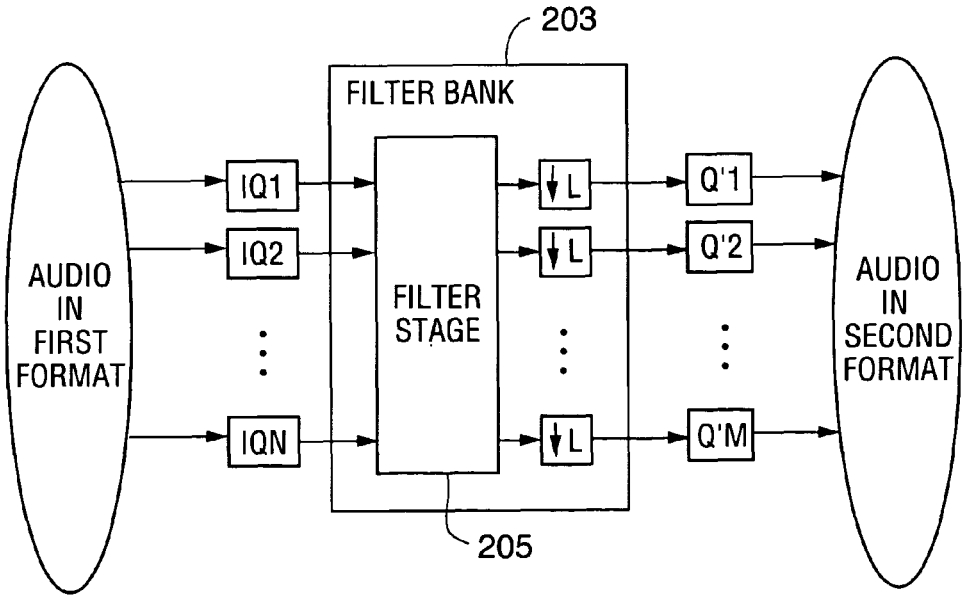
FIG. 5A is a block diagram of another embodiment of the inventive transcoding system.

FIG. 5A is a block diagram of a system that is a variation on the FIG. 5 system, and (like the FIG. 5 system) is configured to implement transcoding in accordance with the invention to generate M streams of quantized frequency coefficients (quantized frequency-band coefficients) of data having a second encoding format (with M coefficients of such data, one from each stream, being indicative of M samples of audio data) in response to N streams of quantized frequency coefficients (quantized frequency-band coefficients) of data having a first encoding format (with N coefficients of such data, one from each stream, being indicative of N samples of audio data). However, in the FIG. 5A system, N and M are arbitrary numbers that satisfy N<M and N=M/L (where L is described below).

Typically, the N streams of quantized frequency-domain coefficients to be transcoded by the FIG. 5A system have been quantized using perceptual criteria in order to achieve the highest audio quality at the desired bit rate. The FIG. 5A system includes an inverse quantization stage (comprising N inverse quantization circuits IQ1, IQ2, . . . , and IQN) configured to reconstruct the original (pre-quantization) frequency-domain coefficients of audio data by performing inverse quantization thereon. The reconstructed frequency-domain coefficients are asserted to filterbank 203.

Filterbank 203 implements partial transcoding of the data values from the inverse quantization stage in accordance with the invention and asserts the partially transcoded data values to a quantization stage (comprising M quantization circuits Q'1, Q'2, . . . , and Q'M). More specifically, a new set of N data values is clocked into filterbank 203's filter stage 205 of filterbank 203 once per N clock cycles. Filter stage 205 generates a new set of M filtered frequency coefficients once per each M/N clock cycles in response to each set of N data values from the inverse quantization stage. Each set of M filtered frequency coefficients is down-sampled (by the above-mentioned factor "L") in a down-sampling stage comprising M down-sampling circuits, once per M clock cycles, such that each such set of M filtered frequency coefficients is clocked out of the down-sampling stage to the quantization stage once per M/N clock cycles. The quantization stage performs quantization on the partially transcoded frequency coefficients (typically in accordance with perceptual criteria) to generate a set of M fully transcoded frequency-domain coefficients (once per M clock cycles). These fully transcoded frequency-domain coefficients can then undergo conventional decoding to reconstruct the original time-domain audio samples therefrom.

With reference again to FIG. 4, MP3 encoder 30 and decimation circuits 32 implement the conventional MP3 encoding function of filterbank 2 of FIG. 2. Encoder 30 generates thirty-two frequency-band coefficients (each corresponding to one of filters $E_0(z)$-$E_{31}(z)$ indicated in FIG. 4) in response to thirty-two consecutive time-domain samples of input audio. Decimation circuits 32 output one such set of thirty-two frequency-band coefficients per each thirty-two consecutive clock periods. Although each such set of thirty-two coefficients values is actually a set of thirty-two frequency-band coefficients (each corresponding to a different frequency band), the processing of these coefficients is sometimes referred to herein as if it were performed on time-domain values. One set of thirty-two frequency-band coefficients is asserted to filterbank 5 per each thirty-two consecutive clock periods. Typically, the frequency-band coefficients clocked into filterbank 5 have undergone quantization in the encoder of a creating device (typically the creating device is a content server, e.g., content server 400 of FIG. 9), and inverse quantization has then been performed on the quantized coefficients to reconstruct the thirty-two frequency-band coefficients that are asserted to filterbank 5 (for processing in elements 34, 36, and $S_0$-$S_7$ of filterbank 5), but the circuitry for performing these operations is not shown in FIG. 4 for simplicity Filter stage 36 of filterbank 5 generates a set of eight data values (each corresponding to one of filters ($M_i(z)+M_{i+1}(z)+M_{i+2}(z)+M_{i+3}(z)$), where i=0, 4, 8, 12, 16, 20, 24, and 28) and asserts this set of eight values (which together are indicative of eight samples of input audio data) at its outputs once per each eight clock cycles, in response to each set of thirty-two frequency-band coefficients clocked out of decimation circuits 32. Each set of eight values generated by stage 36 is actually a set of eight frequency-band coefficients (each corresponding to a different frequency band), but these coefficients may sometimes be referred to herein as time-domain values. Thus, filterbank 5 asserts four sets of eight frequency-band coefficients during each consecutive thirty-two clock cycles.

Each set of eight frequency-band coefficients output from filterbank 5 of FIG. 2 undergoes quantization (but the circuitry for performing quantization is not shown in FIG. 4 for simplicity). At the decoder in the final consuming device (e.g., device 404 of FIG. 8 which is typically a pair of headphones) one set of eight inverse-quantized frequency-band coefficients (sometimes referred to herein as a set of eight time-domain values) is equivalently clocked into up-sampling circuits 38 once per eight clock cycles. Up-sampling circuits 38 and SBC decoding filterbank 40 implement the conventional SBC decoding function of filterbank 8 of FIG. 2. Filterbank 40 applies filters $F_0(z)$-$F_7(z)$ to each set of eight frequency-band coefficients values output from block 5 to generate a sequence of eight reconstructed time-domain samples of the original input audio data. One such time-domain sample is clocked out of filterbank 40 per clock cycle. In order to match the sample rates at the inputs of encoder 30 and the outputs of filterbank 40, a new set of eight data values is clocked into up-sampling circuits 38 once per eight clock cycles of the FIG. 4 system, and is clocked out of up-sampling circuits 38 to filterbank 40 once per clock cycle (eight times per eight clock cycles).

Filterbank 5 includes up-sampling circuits 34, transcoding filter stage 36, and summation circuits $S_0$-$S_7$, connected as shown in FIG. 4. Up-sampling circuits 34 and filter stage 36 implement MP3-to-SBC transcoding in which filter stage 36 applies filters $M_0(z)$-$M_{31}(z)$ to each set of thirty-two reconstructed data values asserted to filterbank 5, to generate a set of thirty-two filtered data values. The outputs of filters $M_0(z)$-$M_3(z)$ are combined in summation unit $S_0$ to generate a first transcoded value (corresponding to filter $M_0(z)+M_1(z)+M_2(z)+M_3(z)$), the outputs of filters $M_4(z)$-$M_7(z)$ are combined in another summation unit (not shown) to generate a second transcoded value (corresponding to filter $M_4(z)+M_5(z)+M_6(z)+M_7(z)$), the outputs of filters $M_8(z)$-$M_{11}(z)$ are combined in another summation unit (not shown) to generate a third transcoded value, the outputs of filters $M_{12}(z)$-$M_{15}(z)$ are combined in another summation unit (not shown) to generate a fourth transcoded value, the outputs of filters $M_{16}(z)$-$M_{19}(z)$ are combined in another summation unit (not shown) to generate a fifth transcoded value, the outputs of filters $M_{20}(z)$-$M_{23}(z)$ are combined in another summation unit (not shown) to generate a sixth transcoded value, the outputs of filters $M_{24}(z)$-$M_{27}(z)$ are combined in another summation unit (not shown) to generate a seventh transcoded value, and the outputs of filters $M_{28}(z)$-$M_{31}(z)$ are combined in summation unit $S_7$ to generate an eight transcoded value (corresponding to filter $M_{28}(z)+M_{29}(z)+M_{30}(z)+M_{31}(z)$).

One such set of eight transcoded values (indicative of at least eight time-domain audio samples) is clocked out of filterbank 5 per eight clock cycles of the FIG. 4 system. In order to match the sample rates at the inputs of encoder 30 and the outputs of filterbank 5, a new set of thirty-two data values is clocked into up-sampling circuits 34 once per thirty-two clock cycles of the FIG. 4 system, and is clocked out of up-sampling circuits 34 to filter stage 36 once per eight clock cycles (four times per thirty-two clock cycles).

For simplicity, FIG. 3 shows and the description thereof assumes that circuits 10 receive only thirty-two (rather than 576) frequency-band coefficients indicative of time-domain samples of input audio data. Thus, the structure shown in FIG. 3 could be employed to implement MPEG1(Layer I)-to-SBC transcoding or MPEG1(Layer II)-to-SBC transcoding. In order to describe how a variation on the structure shown in FIG. 3 would implement MP3-to-SBC transcoding, the description of FIG. 3 provided below should be modified to include another filterbank to the left of FIG. 3. This so-called inner filterbank consists of a summation unit that asserts its output to upsamplers 10 in FIG. 3. Each of the summation units of the inner filterbank sums 18 inputs. An 18× upsampling stage followed by a band-pass filter produces an input to the summation unit. Thus, there are 576 (=32*18) 18× upsamplers followed by 576 band-pass filters ($J'_0(z)$ to $J'_{575}(z)$, where $J'_n(z)=J'_{n+18}(z)$, i.e. only $J'_0(z)$ to $J'_{17}(z)$ are unique) followed by 32 summation units that assert their outputs to stage 10 of FIG. 3. Each of the 576 18× upsamplers receives the 576 reconstructed MP3 frequency sub-band coefficients.

Filterbank 2 (to implement MP3 encoding) actually consists of two filterbanks cascaded, with the first creating thirty-two streams of frequency-band samples and second creating eighteen streams of frequency sub-band samples for each stream of frequency-band samples, and thus creates 576 streams of frequency sub-band samples. However for simplicity FIG. 4 shows and the description thereof assumes only thirty-two filters in each of encoder 30 and stage 36, and thirty-two circuits 32 and thirty-two circuits 34, for generating and transcoding thirty-two streams of frequency-band coefficients (each stream corresponding to a different one of filters $E_0(z)$-$E_{31}(z)$) in response to a stream of time-domain input audio samples. Thus, the structure shown in FIG. 4 could be employed to implement MPEG1(Layer I)-to-SBC transcoding or MPEG1(Layer II)-to-SBC transcoding. In order to implement MP3-to-SBC transcoding, the FIG. 4 system would include implementations of encoder 30 and stage 36 and circuits 32 and 34 (and other circuitry not shown) configured to generate and transcode 576 streams of frequency-band coefficients (one for each different one of 576 frequency sub-bands, each corresponding to a one of 576 different paths through the two filterbanks) in response to a stream of time-domain input audio samples.

The description below of FIG. 4 applies, with minor modifications that will be apparent to one of ordinary skill in the art, to an implementation in which filterbank 5 receives 576 (rather than thirty-two) streams of data values indicative of time-domain samples of input audio data, and generates (and asserts to up-sampling circuits 38) seventy-two sets of eight transcoded frequency-band coefficients in response to each set of 576 data values clocked into filterbank 5. For example, in such an implementation of FIG. 4 (in which filterbank 5 receives 576 streams of data values), each of 576 up-sampling circuits 34 (connected in parallel within filterbank 5) would receive one stream of data values and implement "72×" upsampling thereon (in the sense described below), and filter stage 36 would apply 576 filters $M'_i(z)$, where "i" varies from 0 to 575 to generate eight transcoded frequency components in response to each set of 576 data values clocked into stage 36. One such set of eight transcoded frequency components (indicative of eight time-domain audio samples) would be clocked out of filterbank 5 per clock cycle. In order to match the sample rates at the inputs to encoder 30 and the outputs of filterbank 5, a new set of 576 data values would be clocked into the up-sampling circuits 34 once per 576 clock cycles of the FIG. 4 system, and would be clocked out of up-sampling circuits 34 to filter stage 36 once per eight clock cycles (seventy-two times per 576 clock cycles).

Before explaining in more detail the structure within filterbank 5 of FIG. 4, it is helpful first to consider the conventional structure shown in FIG. 3. FIG. 3 is a block diagram of a simplified implementation of elements 4 and 6 of the conventional FIG. 1 system. FIG. 3 is simplified in the sense that it processes 32 streams of coefficients (rather than 576 streams as discussed above).

In FIG. 3, a new set of thirty-two frequency-band coefficients (output from inverse quantization blocks IQ of FIG. 1) is clocked into up-sampling circuits 10 of filter 4 once per thirty-two clock cycles of the FIG. 1 system. In order to match the sample rates at the inputs of encoder 30 and the outputs of filter stage 12, each set of thirty-two data values is clocked out of up-sampling circuits 10 to filter stage 12 once per clock cycle (thirty-two times per thirty-two clock cycles). Once per clock cycle, filter stage 12 applies filters $H_i(z)$ and combines the filtered outputs of filters $H_i(z)$, to output one reconstructed sample ("T") of the original input audio. Thus, filter stage 12 outputs thirty-two reconstructed samples of the original input audio per thirty-two clock cycles, in response to each new set of thirty-two data values clocked into up-sampling circuits 10.

Once per eight consecutive clock cycles, filter stage 16 of FIG. 3 applies filters $G_i(z)$, where i has range from 0 to 7, to eight reconstructed input audio samples received from filter stage 12 to generate a set of eight, partially SBC-encoded data values (each corresponding to a different frequency band) and asserts such set of eight values to decimation (down-sampling) circuits 18. Decimation circuits 18 outputs one such set of eight partially SBC-encoded values per clock cycle, to MDCT and anti-aliasing circuitry (not shown) which transforms these values into a set of eight frequency coefficients. Each such set of eight frequency coefficients is then quantized in quantizers Q' of FIG. 1 to generate a set of eight quantized frequency coefficients indicative of eight, SBC-encoded samples of the original time-domain input audio. Thus, filter stage 16, circuits 18, and quantizers Q' together output one set of eight quantized frequency coefficients (indicative of eight, SBC-encoded samples of the original time-domain input audio) per eight clock cycles, in response to each eight time-domain data values clocked into filter stage 16 during eight consecutive clock cycles.

In FIG. 4, the impulse response of filters $H_i(z)$ is given by $h_i(n)$ below:

$$h_i(n) = h(n)\cdot\cos\left(\frac{\pi}{32}\left(i+\frac{1}{2}\right)(n+16)\right)$$

$$\text{for } i = 0, \ldots, 31.$$

According to the MPEG1-Layer I, II and III standard specification, filter h(n) is of length 512 and is a low-pass filter with cut-off at $\pi/64$.

The impulse response of filters $G_i(z)$ of FIG. 4 is given by $g_i(n)$ below:

$$g_i(n) = g(n)\cdot\cos\left(\frac{\pi}{8}\left(i+\frac{1}{2}\right)(n-4)\right)$$

$$\text{for } i = 0, \ldots, 7.$$

According to the Bluetooth A2DP SBC specification, filter g(n) is of length 80 and is a low-pass filter with cut-off at $\pi/16$.

Ideally after replacing filters 4 and 6 of FIG. 1 with new filterbank 5 of FIG. 2, the end-to-end transfer function of the FIG. 2 system should be near-unity (it should implement near-perfect reconstruction). This means that in the absence of quantization, the cascade of analysis filterbank 2, filterbank 5, and synthesis filterbank 8 of FIG. 2 should not introduce any aliasing distortions and its transfer function is just a delay.

Preferably, a maximally-decimated implementation of filterbank 5 (as shown in FIG. 4) is used to implement filterbank 5 of FIG. 2. In order to achieve an efficient implementation, it is desirable to derive all the filters $M_i(z)$ of such maximally-decimated implementation of filterbank 5 by cosine-modulation of a low-pass prototype filter M(z). Thus:

$$M_0(z)=M_4(z)=\ldots=M_{24}(z)=M_{28}(z)=e^{j\phi}\cdot M(ze^{-j\pi(0+0.5)/4})+e^{-j\phi}\cdot M(ze^{j\pi(0+0.5)/4})$$

$$M_1(z)=M_5(z)=\ldots=M_{25}(z)=M_{29}(z)=e^{j\phi}\cdot M(ze^{-j\pi(1+0.5)/4})+e^{-j\phi}\cdot M(ze^{j\pi(1+0.5)/4})$$

$$M_2(z)=M_6(z)=\ldots=M_{26}(z)=M_{30}(z)=e^{j\phi}\cdot M(ze^{-j\pi(2+0.5)/4})+e^{-j\phi}\cdot M(ze^{j\pi(2+0.5)/4})$$

$$M_3(z)=M_7(z)=\ldots=M_{27}(z)=M_{31}(z)=e^{j\phi}\cdot M(ze^{-j\pi(3+0.5)/4})+e^{-j\phi}\cdot M(ze^{j\pi(3+0.5)/4})$$

MP3 decoding should achieve near-perfect reconstruction, and sufficient conditions for such near-perfect reconstruction are:

$$H_{4p+q}(z)=M_{4p+q}(z^8)\cdot F_p(z) \text{ for } p=0, 1, \ldots, 7 \text{ and } q=0, 1, 2, 3.$$

Note that $M_{4p+q}(z)=M_q(z)$, so that the conditions become $$H_{4p+q}(z)=M_q(z^8)\cdot F_p(z) \text{ for } p=0, 1, \ldots, 7 \text{ and } q=0, 1, 2, 3.$$

The prototype low-pass filter M(z) is judiciously chosen to be $$H(z)=M(z^8)\cdot F(z).$$

H(z) and F(z) are low-pass prototype filters for MP3 cosine-modulated synthesis filterbank 12, and SBC cosine-modulated synthesis filterbank 40, respectively. Note that H(z) has support from $-\lambda/64$ to $\pi/64$, and F(z) has support from $-\pi/16$ to $\pi/16$. Therefore M(z) must have support from $-\pi/8$ to $\pi/8$.

It may not be possible (or practical) to find a filter M(z) that exactly satisfies the criteria set forth above and has a small finite impulse response. It is contemplated that a small FIR filter M(z) that approximately satisfies the criteria (and the corresponding filters $M_i(z)$ of FIG. 4) will be implemented in typical embodiments of the invention:

$$H(z)=M(z^8)\cdot F(z).$$

Preferably, the phase factor ϕ in the expressions set forth above for filters $M_i(z)$ filters is chosen so that the FIG. 4 system meets an end-to-end linear phase requirement.

By choosing filter M(z) to be a short (512−80)/8 or $54^{th}$ order FIR filter that meets the above constraints, and implementing filters $M_i(z)$ in accordance with such choice of filter M(z), maximally-decimated filterbank 5 of FIG. 4 can be implemented more efficiently than can MP3 synthesis filterbank 4 of FIG. 1 followed by SBC analysis filterbank 6 of FIG. 1 (e.g., maximally-decimated filterbank 5 of FIG. 4 can be implemented more efficiently than can the FIG. 3 system).

To implement the functions of stages 34 and 36 of filterbank 5 of FIG. 4 (with filters $M_i(z)$ determined by the above-noted specific choice of filter M(z)), the only operations required are eight 4×4 DCT computations each followed by low-pass filtering by a filter of order 54. In other words, the only required computations are eight small (4×4) DCTs followed by eight small (54-point) FIR filters run over four samples. For example, in FIG. 4, the top four up-samplers of stage 34 and filters $M_0(z)$, $M_1(z)$, $M_2(z)$, and $M_3(z)$ of stage 36 can be implemented as circuitry for performing a 4×4 DCT followed by a 54-point FIR filter run over four samples.

In contrast, in order to implement the FIG. 3 system (an MP3 synthesis filterbank comprising elements 10 and 12 followed by an SBC analysis filterbank comprising elements 16 and 18), the required computations include one large (32×32) DCT and one large (512-point) FIR filter for MP3 synthesis and one medium-size (8×8) DCT and one medium-size (80-point) FIR filter run four times. In other words, the required computations include one large (32×32) DCT, four medium-size (8×8) DCTs, one large (512-point) FIR filtering operation, and four medium-size (80-point) FIR filtering operations.

Figure 8:
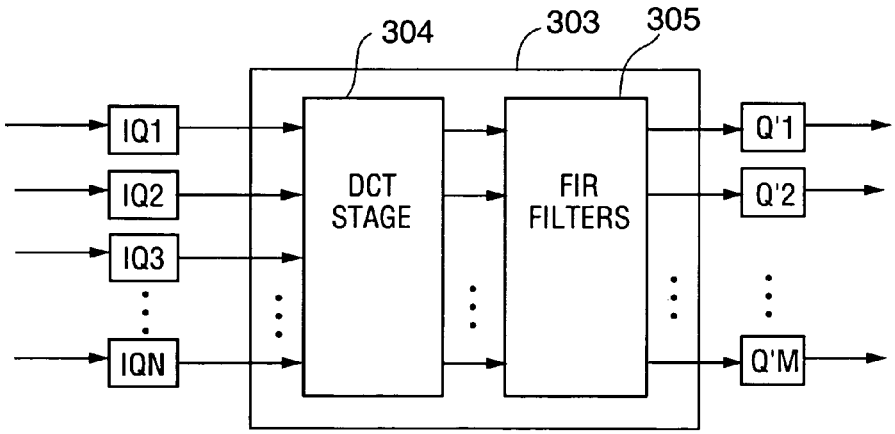
FIG. 8 is a block diagram of another embodiment of the inventive transcoding system.

FIG. 8 is an example of an embodiment of the inventive system which includes combined synthesis and analysis filterbank 303 configured to implement discrete cosine transform (DCT) computations (in DCT stage 304) each followed by low-pass filtering (in filter stage 305). When the FIG. 8 system implements MPEG1(Layer I)-to-SBC transcoding or MPEG1(LayerII)-to-SBC transcoding, stages 304 and 305 implement the functions of stages 34 and 36 of filterbank 5 of FIG. 4 (with filters $M_i(z)$ determined by the above-noted specific choice of filter M(z)), as described in the paragraph preceding the previous paragraph. Alternatively, the FIG. 8 system can implement MP3-to-SBC transcoding (as described below) or transcoding of another type.

The FIG. 8 system includes inverse quantization stage (comprising N inverse quantization circuits I1, I2, . . . , and IN) configured to reconstruct original (pre-quantization) frequency-domain coefficients of audio data by performing inverse quantization thereon. The reconstructed frequency-domain coefficients are asserted to filterbank 303. The index N is equal to 576 to implement MP3-to-SBC transcoding, and is equal to 32 to implement MPEG1(Layer I)-to-SBC or MPEG1(LayerII)-to-SBC transcoding.

Filterbank 303 implements partial transcoding of the data values from the inverse quantization stage in accordance with the invention and asserts the partially transcoded data values to a quantization stage (comprising M quantization circuits Q'1, Q'2, . . . , and Q'M). More specifically, a new set of N data values is clocked into filterbank 103's DCT stage 304 once per N clock cycles, and a set of M transformed data values is clocked out of stage 304 to filter stage 305 once per N/M clock cycles. Filter stage 305 of filterbank 303 generates a new set of M filtered ("partially transcoded") frequency coefficients once per each N/M clock cycles in response to each set of M data values from stage 304. Filter stage 305 asserts each such set of M partially transcoded frequency coefficients to the quantization stage comprising M quantization circuits Q'1, Q'2, . . . , and Q'M. The quantization stage performs quantization on the partially transcoded frequency coefficients (typically in accordance with perceptual criteria) to generate a set of M fully transcoded frequency-domain coefficients (once per M clock cycles). These fully transcoded frequency-domain coefficients can then undergo conventional decoding to reconstruct the original time-domain audio samples therefrom.

To implement the functions of non-simplified versions of stages 34 and 36 of filterbank 5 of a non-simplified version of FIG. 4 for performing MP3-to-SBC transcoding on sets of 576 frequency-band coefficients (rather than sets of 32 frequency-band coefficients as in the simplified version described above), the inventive filterbank (e.g., filterbank 303 of FIG. 8) should implement the equivalent of a MP3 synthesis filterbank implemented as a cascade of two filterbanks (an 18-band inner filterbank and a 32-band outer filterbank), and also an SBC analysis filterbank. The above-described simplified (32-band) version of FIG. 4 combines such an outer MP3 synthesis filterbank and an SBC analysis filterbank (which is a single stage, 8-band filterbank) in accordance with the invention. The combination of just the outer MP3 synthesis filterbank and the SBC analysis filterbank in accordance with the invention improves the efficiency of MP3-to-SBC transcoding significantly. However, its efficiency is further improved by extending the combination to include also the inner MP3 synthesis filterbank.

A non-simplified version of stages 34 and 36 of filterbank 5 of a version of FIG. 4 configured to perform MP3-to-SBC transcoding (e.g., an implementation of filterbank 303 of FIG. 8) operates on sets of 576 inverse-quantized frequency-band coefficients (each set including 18 coefficients for each of 18 different frequency sub-bands of each of 32 different frequency bands) to implement the equivalents of both the above-mentioned inner and outer MP3 synthesis filterbanks (and the equivalent of an SBC analysis filterbank). The only operations required on each set of 576 coefficients are eight 72×72 DCT computations, each followed by low-pass filtering by a 198-point FIR filter (when such DCT computations are performed in DCT stage 304 of FIG. 8, such low-pass filtering can be implemented by FIR filter stage 305). The non-simplified version of filterbank 5 performs operations equivalent to those performed by a version of stage 34 consisting of 576 upsamplers (each performing 72× upsampling on a different stream of frequency-band coefficients), a version of stage 36 consisting of 576 filters $M_0(z)$, . . . , $M_{575}(z)$, each such filter $M_j(z)$ being a 198-point (198=(512−80)/8+36*4) FIR filter, and seven summation circuits (corresponding to circuits $S_0$-$S_7$ of FIG. 4), each such summation circuit configured to combine the outputs of a different subset of 72 of the filters $M_0(z)$-$M_{575}(z)$ (i.e., the first summation circuit configured to add the outputs of $M_0(z)$-$M_{71}(z)$, . . . , the second summation circuit configured to add the outputs of $M_{72}(z)$-$M_{143}(z)$, . . . , and the seventh summation circuit configured to add the outputs of $M_{504}(z)$-$M_{575}(z)$).

In contrast, a non-simplified version of the conventional FIG. 3 system for performing MP3-to-SPB transcoding on sets of 576 inverse-quantized frequency-band coefficients would include an MP3 synthesis filterbank comprising 576 up-samplers (each corresponding to one of up-samplers 10 of FIG. 3, but configured to perform 18× upsampling) and a non-simplified (32×18 band) filter stage corresponding to stage 12, followed by similar second filterbank comprising thirty-two up-samplers 10 of FIG. 3, and a filter stage of stage 12, followed by an SBC analysis filterbank comprising a filter stage 16 and decimation circuits 18 (as in FIG. 3). The operations required on each set of 576 coefficients received by such a system include thirty-two (18×18) DCT computations and thirty-two (36-point) FIR filters on eighteen samples (to implement the inner MP3 synthesis filterbank), eighteen (32×32) DCT computations and eighteen large (512-point) FIR filters on 576 samples (to implement the outer MP3 synthesis filterbank), and a medium-size (8×8) DCT computation and medium-size (80-point) FIR filter run four times (to implement the SBC analysis filterbank). In other words, the required computations include eighteen large (32×32) DCTs, thirty-two large (18×18) DCTs, four (8×8) DCTs, eighteen large (512-point) FIR filtering operations, thirty-two 36-point FIR filtering operations, and four 80-point FIR filtering operations.

Clearly, processing in accordance with typical implementations of the FIG. 4 embodiment of the invention (e.g., to perform any of MPEG1(Layer I)-to-SBC transcoding, MPEG1(LayerII)-to-SBC transcoding, or MP3-to-SBC transcoding) has significant advantages (e.g., reduced computational complexity) relative to processing in accordance with the traditional FIG. 3 approach. In addition, the storage required for operating typical implementations of the FIG. 4 system is much smaller than the storage required to operate typical implementations of the FIG. 3 system. For example, to implement MPEG1(Layer I)-to-SBC or MPEG1(LayerII)-to-SBC transcoding as described with reference to FIG. 4, only a 54-point filter M(z) needs to be stored as opposed to 512-point and 80-point filters H(z) and G(z) for MPEG1 (Layer I)-to-SBC or MPEG1(LayerII)-to-SBC transcoding as described with reference to FIG. 3.

Thus, filterbank 5 of FIG. 2 (and filterbank 5 of FIG. 4) can be configured to perform a small number of cosine transforms (e.g., eight or seventy-two DCTs), each on a different subset of a set of data values indicative of at least one time-domain sample of input audio data (e.g. a set of data values indicative of thirty-two or 576 time-domain samples of input audio data) to generate cosine-transformed data, and to perform low-pass filtering on the cosine-transformed data to generate transformed time-domain data. The transformed data values are transformed frequency-band coefficients that can be quantized to generate transcoded audio data in SBC format (e.g., transcoded audio data in SBC format indicative of thirty-two time-domain samples of input audio data).

Figure 6:
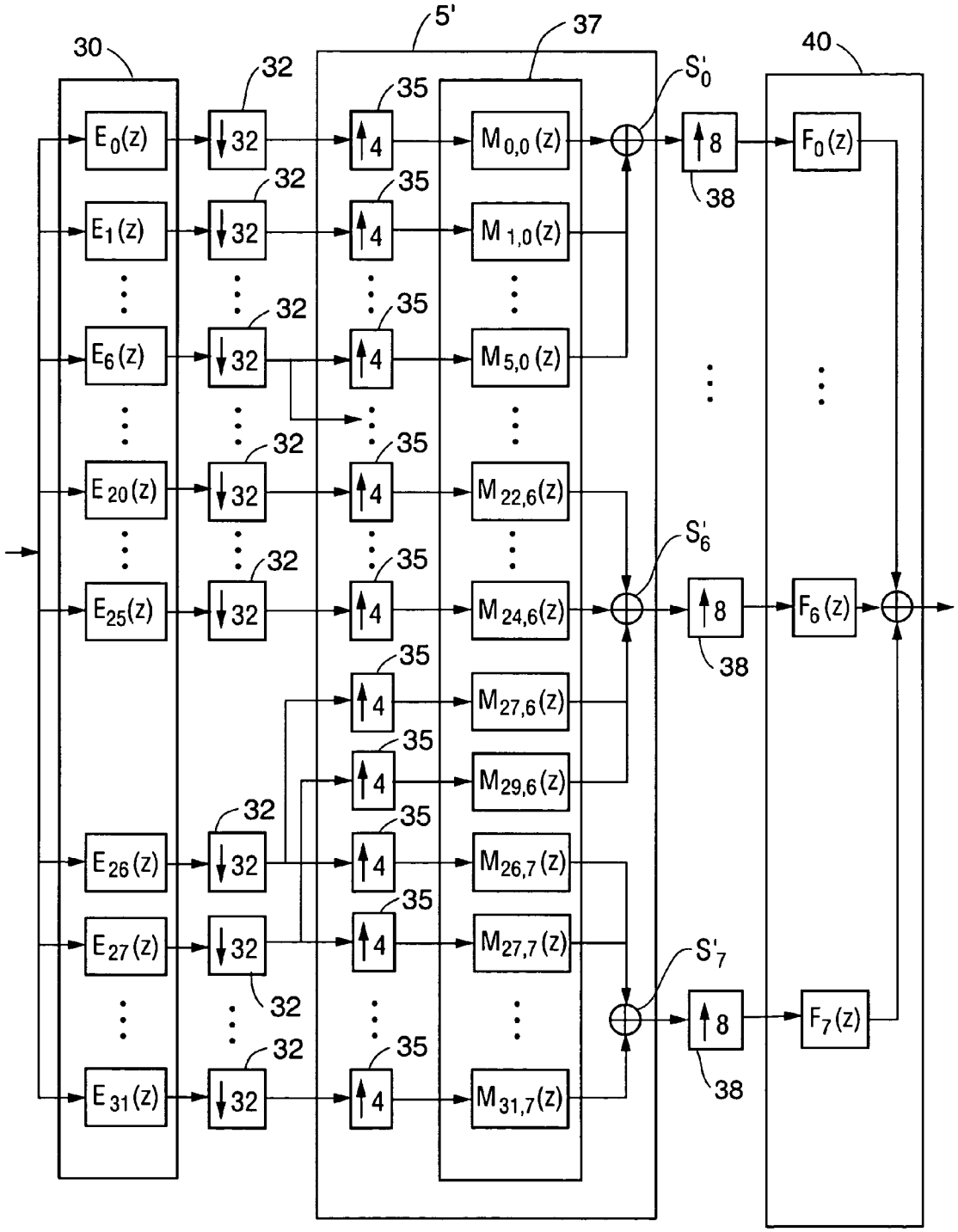
FIG. 6 is a block diagram of another simplified implementation of elements of filterbank 5 of FIG. 2 (which is not a maximally-decimated implementation), also including blocks indicating filtering functions implemented by other elements of the FIG. 2 system.

In another class of embodiments of the inventive system, filterbank 5 of FIG. 2 is implemented as a non-maximally decimated filterbank. Such a system is shown in FIG. 6. All elements of FIG. 6 that are numbered identically to corresponding elements of FIG. 4 are identical in both FIGS. 4 and 6 and the description of these elements will not be repeated with reference to FIG. 6. Combined synthesis and analysis filterbank 5' of FIG. 6 implements filterbank 5 of FIG. 2 (as does combined synthesis and analysis filterbank 5 of FIG. 4).

Filterbank 5' of FIG. 6 differs from filterbank 5 of FIG. 4 in that it includes sixty up-sampling circuits 35 (in place of thirty-two up-sampling circuits 34 as in FIG. 4), and in that its filter stage 37 includes more elements than does corresponding filter stage 36 of FIG. 4. Filter stage 37 generates a set of eight data values (each corresponding to the output of one of summation circuits $S'_0$-$S'_7$) and asserts this set of eight values (which together are indicative of eight samples of input audio data) at its outputs once per each eight clock cycles, in response to each set of thirty-two frequency coefficients clocked out of decimation circuits 32. Thus, filterbank 5' asserts at its outputs four such sets of eight data values during each consecutive thirty-two clock cycles. In order to match the sample rates at the inputs of encoder 30 and the outputs of filterbank 5', a new set of thirty-two data values is clocked into up-sampling circuits 35 once per thirty-two clock cycles of the FIG. 6 system, and is clocked out of up-sampling circuits 35 to filter stage 37 once per eight clock cycles (four times per thirty-two clock cycles).

In elements 35 and 37 of the FIG. 6 system, approximately eight streams of MP3 frequency-band coefficients (which resemble eight streams of time-domain audio data samples and are thus sometimes referred to herein as eight streams of time-domain samples) are combined to generate a signal for each of eight SBC frequency-bands. Note that the first SBC frequency-band signal combines the first 6 MP3 frequency-bands, while the last SBC frequency-band combines the last 6 MP3 frequency-bands. To generate each of the six intermediate SBC frequency-band signals, four overlapping MP3 frequency-bands and two adjacent MP3 frequency-bands on either side are combined.

More specifically, the top six down-sampling circuits 32 are coupled to the top six up-sampling circuits 35 (whose outputs are filtered in filters $M_{0,0}(z)$, $M_{1,0}(z)$, $M_{2,0}(z)$, $M_{3,0}(z)$, $M_{4,0}(z)$, and $M_{5,0}(z)$), the bottom six down-sampling circuits 32 are coupled to the bottom six up-sampling circuits 35 (whose outputs are filtered in filters $M_{26,7}(z)$, $M_{27,7}(z)$, $M_{28,7}(z)$, $M_{29,7}(z)$, $M_{30,7}(z)$, and $M_{31,7}(z)$), the eight down-sampling circuits 32 above the bottom four circuits 32 are coupled to the eight corresponding up-sampling circuits 35 (whose outputs are filtered in filters $M_{22,6}(z)$, $M_{23,6}(z)$, $M_{24,6}(z)$, $M_{25,6}(z)$, $M_{26,6}(z)$, $M_{27,6}(z)$, $M_{28,6}(z)$, and $M_{29,6}(z)$), and so on. The outputs of filters $M_{0,0}(z)$, $M_{1,0}(z)$, $M_{2,0}(z)$, $M_{3,0}(z)$, $M_{4,0}(z)$, and $M_{5,0}(z)$ are combined in circuit $S'_0$, the outputs of filters $M_{26,7}(z)$, $M_{27,7}(z)$, $M_{28,7}(z)$, $M_{29,7}(z)$, $M_{30,7}(z)$, and $M_{31,7}(z)$ are combined in circuit $S'_7$, the outputs of filters $M_{22,6}(z)$, $M_{23,6}(z)$, $M_{24,6}(z)$, $M_{25,6}(z)$, $M_{26,6}(z)$, $M_{27,6}(z)$, $M_{28,6}(z)$, and $M_{29,6}(z)$ are combined in circuit $S'_6$, and so on.

In order to derive the correct filters $M_{p,q}(z)$, where index "q" ranges from 0 to 7 and index "p" ranges from 0 to 31, the correct branches of the MP3 synthesis filter (G(z)) of FIG. 3 should be combined with corresponding branches of the SBC analysis filter (H(z)) of FIG. 3, and that theoretically each SBC analysis sub-band filter $G_q(z)$ of FIG. 3 should be cascaded with each MP3 synthesis sub-band filter $H_p(z)$. As noted above, in the FIG. 6 implementation the combinations are restricted to no more than eight MP3 sub-band filters $H_p(z)$ that overlap and are adjacent to each $G_q(z)$. In other words, p=4q−2, 4q−1, 4q, . . . , 4q+4, 4q+5, and 0<=p<=31. One such branch is illustrated in FIG. 7.

More specifically, filter stage 37 of FIG. 6 has sixty branches and implements only sixty filters $M_{p,q}(z)$. The sixty filters $M_{p,q}(z)$ that are implemented are determined with the restrictions that each $G_q(z)$ is paired with up to eight overlapping filters $H_p(z)$, where p=4q−2, 4q−1, 4q, . . . , 4q+4, 4q+5, but $G_q(z)$ can be paired with just six filters from H bank, $H_0(z), H_1(z), \ldots, H_5(z)$, since $H_{-2}(z)$, and $H_{-1}(z)$ do not exist, and $G_7(z)$ can be paired with just six filters $H_{26}(z)$, $H_{27}(z), \ldots, H_{31}(z)$, since $H_{32}(z)$, and $H_{33}(z)$ do not exist.

Figure 7:
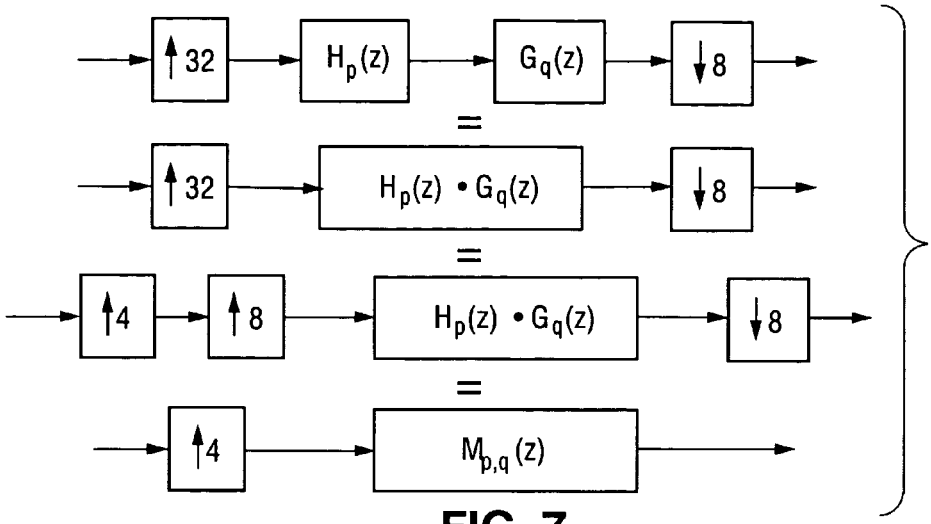
FIG. 7 is a diagram of steps that can be employed to generate the filters Mp,q(z) implemented by filter stage 37 of FIG. 6.

Consistent with FIG. 7, the result is that each filter $M_{p,q}(z)$ is given by:

$$M_{p,q}(z)=(H_p(z)\cdot G_q(z))_{\downarrow 8}.$$

That is, the filter $M_{p,q}(z)$ is one of the eight polyphase components of the filter $H_p(z)G_q(z)$. Since $H_p(z)$ is of order 512 and $G_q(z)$ is of order 80, the filters $M_{p,q}(z)$ are of order (512+80)/8 or 74.

Figure 9:
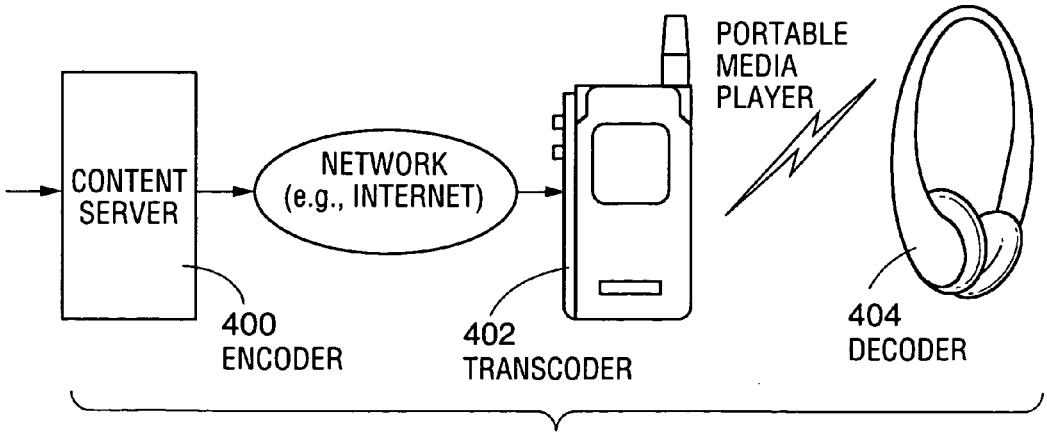
FIG. 9 is a block diagram of another embodiment of the inventive transcoding system.

FIG. 9 is a block diagram of another embodiment of the inventive transcoding system. The FIG. 9 system includes content server 400 which generates encoded audio data in a first encoding format. This audio data is transmitted over a link or network (e.g., the Internet) to transcoder 402 (which may be implemented in a portable media player). Transcoder 402 performs transcoding on the audio data in accordance with the invention, to generate transcoded audio data in a second encoding format in response thereto. The transcoded audio data are transmitted over a link or network (e.g., a wireless link) to decoder 404 (which may be implemented in a pair of headphones or other consuming device). Encoder 400 can implement filterbank 2 (and quantizers Q) of FIG. 2, transcoder 402 can implement filterbank 5 (inverse quantizers IQ and quantizers Q') of FIG. 2, and decoder 404 can implement filterbank 8 (and inverse quantizers IQ') of FIG. 2. Regardless of how encoder 400 and decoder 404 are implemented, the end-to-end transfer function of encoder 400, transcoder 402, and decoder 404 should be near-unity (it should implement near-perfect reconstruction). The manner in which encoder 400 and decoder 404 are implemented is not an object of the present invention. Indeed, some embodiments of the invention are limited to a transcoder, and do not include an encoder (for asserting encoded data to the transcoder) or a decoder (for decoding the transcoded data output from the transcoder).

Although the specific embodiments of the invention described herein are chosen because of their commercial importance, the principles of operation described herein are also applicable to transcoding of audio data in other formats (e.g., other perceptual transform coding formats).

It should be understood that while some embodiments of the present invention are illustrated and described herein, the invention is defined by the claims and is not to be limited to the specific embodiments described and shown.

What is claimed is:

1. A filterbank comprising:

a first component configured to receive a first plurality of coefficients, wherein said first plurality of coefficients are associated with a first audio format;

a second component coupled to said first component, wherein said second component is configured to generate a second plurality of coefficients based upon said first plurality of coefficients, wherein said second plurality of coefficients are associated with a second audio format, wherein said second component is further configured to generate said second plurality of coefficients using at least one operation performed in the frequency domain, and wherein said second component is further configured to generate said second plurality of coefficients by performing at least one operation associated with summation and at least one operation associated with low-pass filtering, and wherein said second component is further configured to generate said second plurality of coefficients by performing said at least one operation associated with summation between a plurality of operations associated with upsampling; and a third component coupled to the second component, wherein said third component is configured to output said second plurality of coefficients.

2. The filterbank of claim 1, wherein said second component comprises:

a fourth component operable to upsample said first plurality of coefficients to generate first data; and a fifth component coupled to said fourth component, wherein said fifth component is operable to filter said first data to generate said second plurality of coefficients.

3. The filterbank of claim 1, wherein said second component comprises:

a fourth component operable to perform at least one discrete cosine transform on said first plurality of coefficients to generate first data; and a fifth component coupled to said fourth component, wherein said fifth component is operable to low-pass filter said first data to generate said second plurality of coefficients.

4. The filterbank of claim 1, wherein said first audio format is selected from a group consisting of MPEG1-Layer I, MPEG1-Layer II, MPEG1-Layer III, and a sub band coding format.

5. The filterbank of claim 1, wherein said second audio format is selected from a group consisting of MPEG1-Layer I, MPEG1-Layer II, MPEG1-Layer III, and a sub band coding format.

6. The filterbank of claim 1, wherein said first plurality of coefficients comprise a first plurality of frequency-band coefficients.

7. The filterbank of claim 1, wherein said second plurality of coefficients comprise a second plurality of frequency-band coefficients.

8. A system for transcoding audio data, said system comprising:

a first component configured to access first data encoded in a first audio format and further configured to perform at least one inverse quantization operation on said first data to generate a first plurality of coefficients;

a filterbank coupled to said first component, wherein said filterbank comprises:

a second component configured to receive said first plurality of coefficients, wherein said first plurality of coefficients are associated with said first audio format;

a third component coupled to said second component and configured to generate a second plurality of coefficients based upon said first plurality of coefficients, wherein said second plurality of coefficients are associated with a second audio format, wherein said third component is further configured to generate said second plurality of coefficients using at least one operation performed in the frequency domain, and wherein said third component is further configured to generate said second plurality of coefficients by performing at least one operation associated with summation and at least one operation associated with low-pass filtering, and wherein said third component is further configured to generate said second plurality of coefficients by performing said at least one operation associated with summation between a plurality of operations associated with upsampling; and a fourth component coupled to the third component, wherein said fourth component is configured to output said second plurality of coefficients; and a fifth component coupled to said filterbank and configured to access said second plurality of coefficients, and wherein said fifth component is further configured to perform at least one quantization operation on said second plurality of coefficients to generate second data encoded in a second audio format.

9. The system of claim 8 further comprising:

a sixth component coupled to said first component and operable to encode first audio to generate said first data encoded in said first audio format.

10. The system of claim 8 further comprising:

a sixth component coupled to said fifth component and operable to decode said second data encoded in said second audio format to generate second audio.

11. The system of claim 8, wherein said third component comprises:

a sixth component operable to upsample said first plurality of coefficients to generate first data; and a seventh component coupled to said sixth component, wherein said seventh component is operable to filter said first data to generate said second plurality of coefficients.

12. The system of claim 8, wherein said third component comprises:

a sixth component operable to perform at least one discrete cosine transform on said first plurality of coefficients to generate first data; and a seventh component coupled to said sixth component, wherein said seventh component is operable to low-pass filter said first data to generate said second plurality of coefficients.

13. The system of claim 8, wherein said first audio format is selected from a group consisting of MPEG1-Layer I, MPEG1-Layer II, MPEG1-Layer III, and a sub band coding format.

14. The system of claim 8, wherein said second audio format is selected from a group consisting of MPEG1-Layer I, MPEG1-Layer II, MPEG1-Layer III, and a sub band coding format.

15. The system of claim 8, wherein said first plurality of coefficients comprise a first plurality of frequency-band coefficients.

16. The system of claim 8, wherein said second plurality of coefficients comprise a second plurality of frequency-band coefficients.

17. A method of transcoding audio data, said method comprising:

receiving a first plurality of coefficients, wherein said first plurality of coefficients are associated with a first audio format;

generating a second plurality of coefficients based upon said first plurality of coefficients, wherein said second plurality of coefficients are associated with a second audio format, wherein said generating said second plurality of coefficients further comprises generating said second plurality of coefficients using at least one operation performed in the frequency domain, wherein said generating said second plurality of coefficients further comprises generating said second plurality of coefficients by performing at least one operation associated with summation and at least one operation associated with low-pass filtering, and wherein said generating said second plurality of coefficients further comprises generating said second plurality of coefficients by performing said at least one operation associated with summation between a plurality of operations associated with upsampling; and outputting said second plurality of coefficients.

18. The method of claim 17 further comprising:

accessing first data encoded in a first audio format; and performing at least one inverse quantization operation on said first data to generate a first plurality of coefficients.

19. The method of claim 17 further comprising:

accessing said second plurality of coefficients; and performing at least one quantization operation on said second plurality of coefficients to generate second data encoded in a second audio format.

20. The method of claim 17 further comprising:

encoding first audio to generate said first data encoded in said first audio format.

21. The method of claim 17 further comprising:

decoding said second data encoded in said second audio format to generate second audio.

22. The method of claim 17, wherein said generating said second plurality of coefficients further comprises:

upsampling said first plurality of coefficients to generate first data; and filtering said first data to generate said second plurality of coefficients.

23. The method of claim 17, wherein said generating said second plurality of coefficients further comprises:

performing at least one discrete cosine transform on said first plurality of coefficients to generate first data; and low-pass filtering said first data to generate said second plurality of coefficients.

24. The method of claim 17, wherein said first audio format is selected from a group consisting of MPEG1-Layer I, MPEG1-Layer II, MPEG1-Layer III, and a sub band coding format.

25. The method of claim 17, wherein said second audio format is selected from a group consisting of MPEG1-Layer I, MPEG1-Layer II, MPEG1-Layer III, and a sub band coding format.

26. The method of claim 17, wherein said first plurality of coefficients comprise a first plurality of frequency-band coefficients.

27. The method of claim 17, wherein said second plurality of coefficients comprise a second plurality of frequency-band coefficients.

* * * * *